US007749097B2

(12) United States Patent
Foster et al.

(10) Patent No.: US 7,749,097 B2
(45) **Date of Patent: *Jul. 6, 2010**

(54) GOLF CLUB HEAD

(75) Inventors: Philip G. Foster, Carlsbad, CA (US); Evan D. Gibbs, Encinitas, CA (US); J. Andrew Galloway, Escondido, CA (US); Michael Hallack, Carlsbad, CA (US); Luke R. Williams, Carlsbad, CA (US); Alan Hocknell, Carlsbad, CA (US); Matthew T. Cackett, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/636,460

(22) Filed: Dec. 11, 2009

(65) Prior Publication Data

US 2010/0093464 A1 Apr. 15, 2010

Related U.S. Application Data

(63) Continuation of application No. 12/487,581, filed on Jun. 18, 2009, now Pat. No. 7,637,822, which is a continuation of application No. 12/240,425, filed on Sep. 29, 2008, now Pat. No. 7,549,935, which is a continuation-in-part of application No. 11/868,621, filed on Oct. 8, 2007, now Pat. No. 7,476,161, which is a continuation of application No. 11/738,850, filed on Apr. 23, 2007, now Pat. No. 7,306,527, which is a continuation of application No. 11/625,176, filed on Jan. 19, 2007, now Pat. No. 7,291,075, which is a continuation of application No. 11/161,199, filed on Jul. 26, 2005, now Pat. No. 7,166,038.

(60) Provisional application No. 60/641,283, filed on Jan. 3, 2005, provisional application No. 60/893,932, filed on Mar. 9, 2007, now abandoned.

(51) Int. Cl.
*A63B 53/04* (2006.01)

(52) U.S. Cl. ..... 473/329; 473/335; 473/345; 473/348; 473/349

(58) Field of Classification Search ..... 473/324–350, 473/287–292, 256

See application file for complete search history.

(56) References Cited

U.S. PATENT DOCUMENTS

| | | | |
|---|---|---|---|
| 1,167,387 | A | 1/1916 | Daniel |
| 1,568,888 | A | 1/1926 | Dunn |
| 1,638,916 | A | 8/1927 | Butchart |
| 1,780,625 | A | 11/1930 | Mattern |
| 2,336,405 | A | 12/1943 | Kent |
| 2,750,194 | A | 6/1956 | Clark |
| D179,002 | S | 10/1956 | Hoffmeister |

(Continued)

*Primary Examiner*—Sebastiano Passaniti
(74) *Attorney, Agent, or Firm*—Michael A. Catania

(57) ABSTRACT

A golf club head (42) having a substantially square or rectangular body is disclosed herein. The golf club head (42) preferably has a volume ranging from 420 cubic centimeters to 470 cubic centimeters. The golf club head (42) preferably has a face component (60), a mid-body (61) and an aft-weight component (65). The golf club head (42) preferably has a moment of inertia about the Izz axis through the center of gravity of the golf club head greater than 4000 grams-centimeters squared.

9 Claims, 6 Drawing Sheets

U.S. PATENT DOCUMENTS 3,397,888 A 8/1968 Springer et al.
3,486,755 A 12/1969 Hodge
3,692,306 A 9/1972 Glover
D226,431 S 3/1973 Baker
D229,431 S 11/1973 Baker
3,897,066 A 7/1975 Belmont
3,901,514 A 8/1975 Priaulx
3,937,474 A 2/1976 Jepson et al.
3,975,023 A 8/1976 Inamori
3,981,507 A 9/1976 Nunziato
3,989,248 A 11/1976 Campau
4,010,958 A 3/1977 Long
4,021,047 A 5/1977 Mader
D268,357 S 3/1983 Mader
4,398,965 A 8/1983 Campau
4,568,088 A 2/1986 Kurahashi
4,872,685 A 10/1989 Sun
4,877,249 A 10/1989 Thompson
5,106,094 A 4/1992 Desboilles et al.
5,193,811 A 3/1993 Okumoto et al.
5,282,624 A 2/1994 Viste
5,310,185 A 5/1994 Viollaz et al.
5,344,140 A 9/1994 Anderson
5,346,216 A 9/1994 Aizawa
5,346,217 A 9/1994 Tsuchiya et al.
5,377,986 A 1/1995 Viollaz et al.
5,398,935 A 3/1995 Katayama
5,410,798 A 5/1995 Lo
5,421,577 A 6/1995 Kobayashi
5,425,538 A 6/1995 Vincent et al.
5,431,401 A 7/1995 Smith
5,464,210 A 11/1995 Davis et al.
5,474,296 A 12/1995 Schmidt et al.
5,499,814 A 3/1996 Lu
5,516,107 A 5/1996 Okumoto et al.
5,547,427 A 8/1996 Rigal et al.
5,570,886 A 11/1996 Rigal et al.
5,624,331 A 4/1997 Lo et al.
5,743,813 A 4/1998 Chen et al.
5,776,011 A 7/1998 Su et al.
5,830,084 A 11/1998 Kosmatka
5,836,830 A 11/1998 Onuki et al.
5,863,261 A 1/1999 Eggiman
5,888,148 A 3/1999 Allen
5,947,838 A 9/1999 Tkacs
D415,807 S 10/1999 Werner et al.
5,985,197 A 11/1999 Nelson et al.
6,012,989 A 1/2000 Saksun
6,048,278 A 4/2000 Meyer et al.
6,146,571 A 11/2000 Vincent et al.
6,149,534 A 11/2000 Peters et al.
6,152,833 A 11/2000 Werner et al.
6,165,081 A 12/2000 Chou
6,310,185 B1 10/2001 Wallace et al.
6,332,848 B1 12/2001 Long et al.
6,334,817 B1 1/2002 Ezawa et al.
6,348,015 B1 2/2002 Kosmatka
6,354,962 B1 3/2002 Galloway et al.
6,390,933 B1 5/2002 Galloway et al.
6,406,381 B2 6/2002 Murphy et al.
6,478,692 B2 11/2002 Kosmatka
6,488,594 B1 12/2002 Card et al.
6,602,149 B1 8/2003 Jacobson
6,648,773 B1 11/2003 Evans
D489,105 S 4/2004 Kim
D524,890 S 7/2006 Foster et al.

GOLF CLUB HEAD

CROSS REFERENCES TO RELATED APPLICATIONS

The Present Application is a continuation application of U.S. patent application Ser. No. 12/487,581, filed on Jun. 18, 2009 now U.S. Pat. No. 7,637,822, which is a continuation application of U.S. patent Ser. No. 12/240,425, filed on Sep. 29, 2008, now U.S. Pat. No. 7,549,935, which is a continuation-in-part application of U.S. patent application Ser. No. 11/868,621, filed on Oct. 8, 2007, now U.S. Pat. No. 7,476,161, which is a continuation application of U.S. patent application Ser. No. 11/738,850, filed on Apr. 23, 2007, now U.S. Pat. No. 7,306,527, which is a continuation of U.S. patent application Ser. No. 11/625,176, filed on Jan. 19, 2007, now U.S. Pat. No. 7,291,075, which is a continuation of U.S. patent application Ser. No. 11/161,199, filed on Jul. 26, 2005, now U.S. Pat. No. 7,166,038, which claims priority to U.S. Provisional Patent Application No. 60/641,283, filed Jan. 3, 2005, now abandoned. The Present Application also claims priority to U.S. patent application Ser. No. 12/025,503, filed on Feb. 4, 2008, which claims priority to U.S. Provisional Patent Application No. 60/893,932 filed on Mar. 9, 2007, now abandoned. The present application also claims priority to U.S. patent application Ser. No. 11/928,318, filed on Oct. 30, 2007 now U.S. Pat. No. 7,448,960, which is a continuation application of U.S. patent application Ser. No. 11/841,384, filed on Aug. 20, 2007, now U.S. Pat. No. 7,422,528, which is a continuation application of U.S. patent application Ser. No. 11/469,742, filed on Sep. 1, 2006, now U.S. Pat. No. 7,258,626, which is a continuation application of U.S. patent application Ser. No. 10/904,332, filed on Nov. 4, 2004, now U.S. Pat. No. 7,101,289, which is a continuation-in-part application of U.S. patent application Ser. No. 10/711,825, filed on Oct. 7, 2004, now U.S. Pat. No. 7,137,907.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a substantially square or substantially rectangular golf club head.

2. Description of the Related Art

U.S. Pat. No. 1,780,625 to Mattern discloses a club head with a rear portion composed of a light-weight metal, such as magnesium. U.S. Pat. No. 1,638,916 to Butchart discloses a golf club with a balancing member composed of persimmon or a similar wood material, and a shell-like body composed of aluminum attached to the balancing member.

U.S. Pat. No. 3,981,507 to Nunziato discloses a cube-like club head to provide a rectangular face.

U.S. Pat. No. 2,336,405 to Kent discloses a golf club with a trapezoidal shaped club head.

U.S. Pat. No. D226,431 to Baker discloses a design for a club head with a greater rear-wall.

U.S. Pat. No. 3,397,888 to Springer et al., discloses a putter head with a rectangular shape.

U.S. Pat. No. 3,486,755 to Hodge discloses a putter with a triangular-like shape.

U.S. Pat. No. 3,901,514 discloses a putter with a club head shaped like a ring.

U.S. Pat. No. D179,002 to Hoffmeister discloses a design for a club head with a circular face and an elongated body.

BRIEF SUMMARY OF THE INVENTION

One aspect of the present invention is a substantially square golf club head with a moment of inertia, Izz, about the center of gravity of the golf club head that exceeds 4000 grams-centimeter squared.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
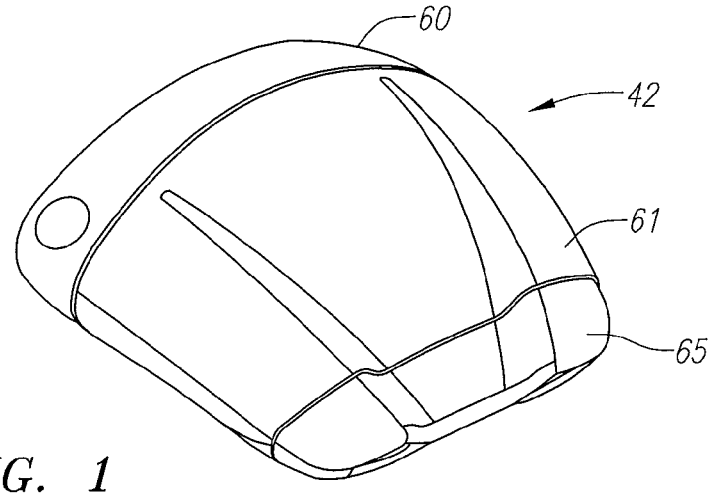
FIG. 1 is a rear perspective view of a club head of the present invention.
Figure 2:
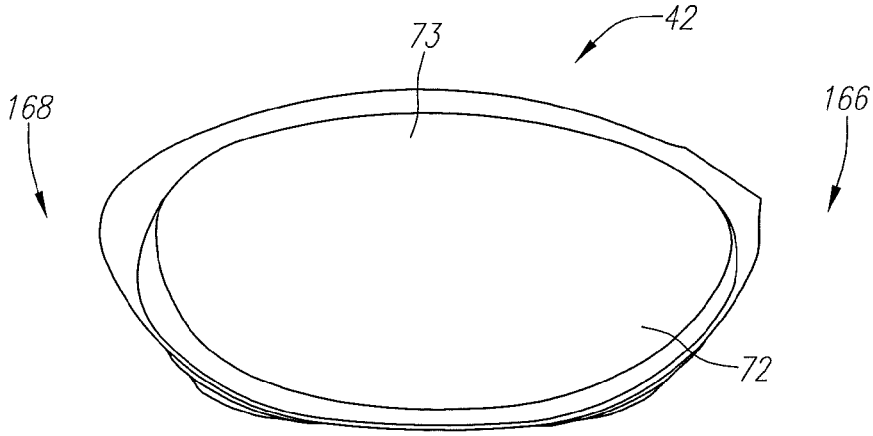
FIG. 2 is a front view of a golf club of the present invention.

The present invention is generally directed at a golf club head that has a substantially square or rectangular shape as viewed from the top or bottom (as opposed to a side view) and has relatively high moments of inertia Izz and Iyy about the center of gravity of the golf club head. A general embodiment of the club head is illustrated in FIGS. 1-9. A more detailed description of a substantially square or rectangular shape golf club head is provided in Williams et al., U.S. Pat. No. 7,291,075 for a Golf Club Head, which is hereby incorporated by reference in its entirety.

As shown in FIGS. 1-9, a golf club head of the present invention is generally designated 42. In a preferred embodiment, the club head 42 is generally composed of three components, a face component 60, a mid-body 61, and an aft-weight component 65. The mid-body 61 preferably has a crown section 62 and a sole section 64. The mid-body 61 optionally has a ribbon section 90.

The golf club head 42, when designed as a driver, preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. The volume of the golf club head 42 will also vary between fairway woods (preferably ranging from 3-woods to eleven woods) with smaller volumes than drivers.

The golf club head 42, when designed as a driver, preferably has a mass no more than 215 grams, and most preferably a mass of 180 to 215 grams. When the golf club head 42 is designed as a fairway wood, the golf club head preferably has a mass of 135 grams to 200 grams, and preferably from 140 grams to 165 grams.

The face component 60 is generally composed of a single piece of metal, and is preferably composed of a formed or forged metal material. More preferably, the metal material is a titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, machining, powdered metal forming, metal-injection-molding, electro chemical milling, and the like.

The face component 60 generally includes a striking plate (also referred to herein as a face plate) 72 and a return portion 74 extending laterally inward from a perimeter 73 of the striking plate 72. The striking plate 72 typically has a plurality of scorelines 75 thereon. The striking plate 72 preferably has a thickness ranging from 0.010 inch to 0.250 inch, and the return portion 74 preferably has a thickness ranging from 0.010 inch to 0.250 inch. The return portion 74 preferably extends a distance ranging from 0.25 inch to 1.5 inches from the perimeter 73 of the striking plate 72.

In a preferred embodiment, the return portion 74 generally includes an upper lateral section 76, a lower lateral section 78, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate 72, such as 270 degrees or 180 degrees, and may also be discontinuous.

The upper lateral section 76 preferably extends inward, towards the mid-body 61, a predetermined distance to engage the crown section 62. In a preferred embodiment, the predetermined distance ranges from 0.2 inch to 1.2 inch, more preferably 0.40 inch to 1.0 inch, and most preferably 0.8 inch, as measured from the perimeter 73 of the striking plate 72 to the rearward edge of the upper lateral section 76. In a preferred embodiment, the upper lateral section 76 is substantially straight and substantially parallel to the striking plate 72 from the heel end 166 to the toe end 168.

The perimeter 73 of the striking plate 72 is preferably defined as the transition point where the face component 60 transitions from a plane substantially parallel to the striking plate portion 72 to a plane substantially perpendicular to the striking plate 72. Alternatively, one method for determining the transition point is to take a plane parallel to the striking plate 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate 72.

The heel lateral section 80 is substantially perpendicular to the striking plate 72, and the heel lateral section 80 preferably covers a portion of a hosel 54 before engaging an optional ribbon section 90 and a bottom section 91 of the sole section 64 of the mid-body 61. The heel lateral section 80 is attached to the sole section 64, both the ribbon section 90 and the bottom section 91, as explained in greater detail below. The heel lateral section 80 extends inward a distance from the perimeter 73 a distance of 0.2 inch to 1.2 inch, more preferably 0.40 inch to 1.0 inch, and most preferably 0.8 inch. The heel lateral section 80 is preferably straight at its edge.

At the other end of the face component 60 is the toe lateral section 82. The toe lateral section 82 is preferably attached to the sole section 64, both the ribbon 90 and the bottom section 91, as explained in greater detail below. The toe lateral section 82 extends inward a distance from the perimeter 73 a distance of 0.2 inch to 1.2 inch, more preferably 0.40 inch to 1.0 inch, and most preferably 0.8 inch. The toe lateral section 82 preferably is preferably straight at its edge.

The lower lateral section 78 extends inward, toward the aft-body 61, a distance to engage the sole portion 64. In a preferred embodiment, the distance d ranges from 0.2 inch to 1.2 inch, more preferably 0.40 inch to 1.0 inch, and most preferably 0.8 inch, as measured from the perimeter 73 of the striking plate portion 72 to the edge of the lower lateral section 78.

The mid-body 61 is preferably composed of a non-metal material, preferably a composite material such as continuous fiber pre-preg material (including thermosetting materials or thermoplastic materials for the resin). Other materials for the mid-body 61 include other thermosetting materials or other thermoplastic materials such as injectable plastics. Alternatively, the mid-body 61 is composed of low-density metal materials, such as magnesium or aluminum. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The mid-body 61 is preferably manufactured through metal-injection-molding. Alternatively, the mid-body 61 is manufactured through casting, forming, machining, powdered metal forming, electro chemical milling, and the like.

The mid-body 61 is preferably manufactured through bladder-molding, resin transfer molding, resin infusion, injection molding, compression molding, or a similar process. In a preferred process, the face component 60, with an adhesive on the interior surface of the return portion 74, is placed within a mold with a preform of the mid-body 61 for bladder molding. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M Company. Alternatively, foam tapes such as Hysol Synspan may be utilized with the present invention.

A bladder is placed within the hollow interior of the preform and face component 60, and is pressurized within the mold, which is also subject to heating. The co-molding process secures the mid-body 61 to the face component 60. Alternatively, the mid-body 61 is bonded to the face component 60 using an adhesive, or mechanically secured to the return portion 74.

The crown portion 62 of the mid-body 61 engages the ribbon section 90 of sole section 64 outside of the engagement with the face component 60. The crown section 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole section 64, including the bottom section 91 and the optional ribbon section 90, which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. In a preferred embodiment, the mid-body 61 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety.

The hosel 54 is preferably at least partially disposed within the hollow interior of the club head 42, and is preferably located as a part of the face component 60. The hosel 54 is preferably composed of a similar material to the face component 60, and is preferably secured to the face component 60 through welding or the like. Alternatively, the hosel 54 may be formed with the formation of the face component 60.

Figure 3:
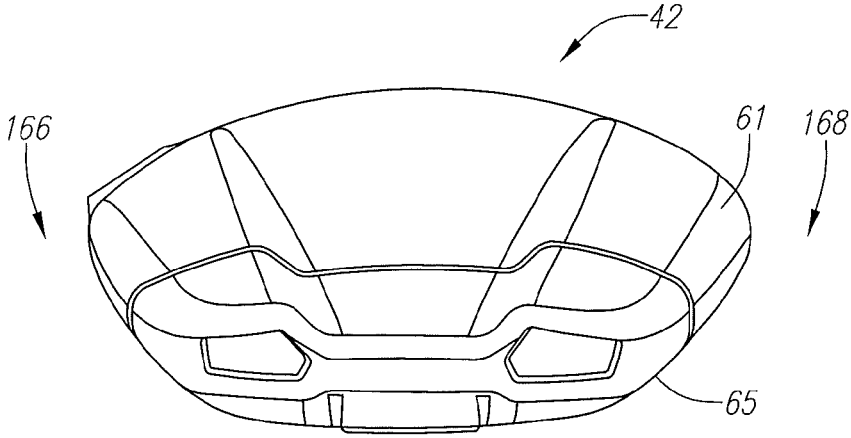
FIG. 3 is a rear view of the club head of FIG. 1.

The club head 42 preferably has a heel end 166, a toe end 168 and an aft-end 170 that are substantially straight. As shown in FIG. 3, the heel end 166 has a distance, "Dhw", from a furthest forward extent of the club head 42 to a furthest rearward extent of the club head 42 that preferably ranges from 2.00 to 5.00 inches, more preferably from 3.0 to 5.0 inches, and most preferably from 4.5 to 5.0 inches.

Figure 4:
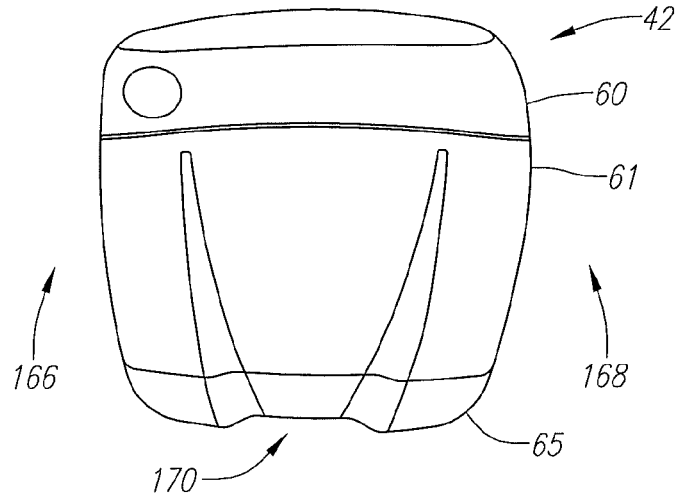
FIG. 4 is a top plan view of the club head of FIG. 1.

As shown in FIG. 4, the toe end 168 has a distance, "Dtw", from a furthest forward extent of the club head 42 to a furthest rearward extent of the club head 42 that preferably ranges from 2.00 to 5.00 inches, more preferably from 3.0 to 5.0 inches, and most preferably from 4.5 to 5.0 inches.

Figure 5:
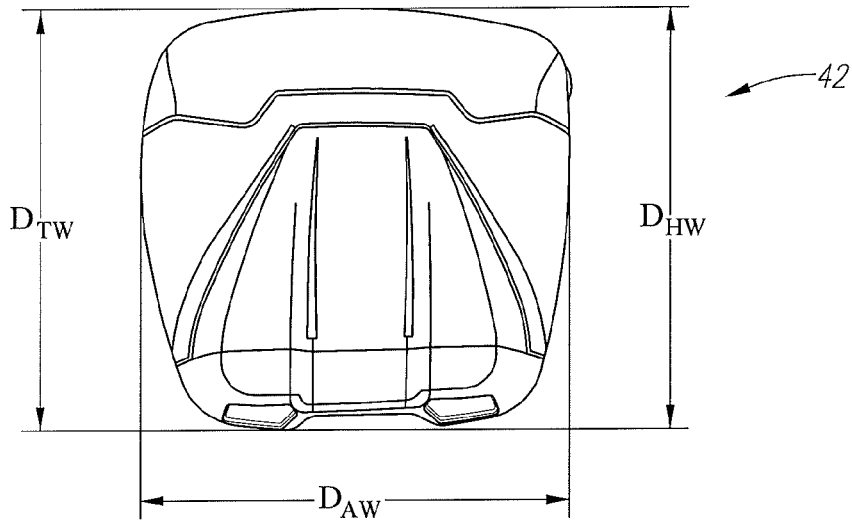
FIG. 5 is a bottom plan view of the club head of FIG. 1.
Figure 6:
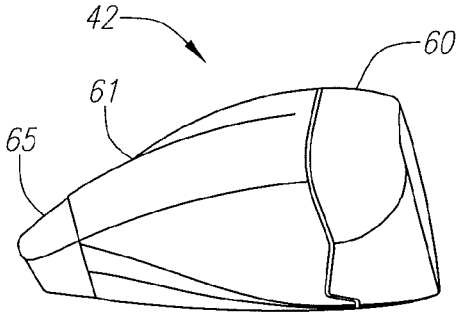
FIG. 6 is a toe side view of the club head of FIG. 1.
Figure 7:
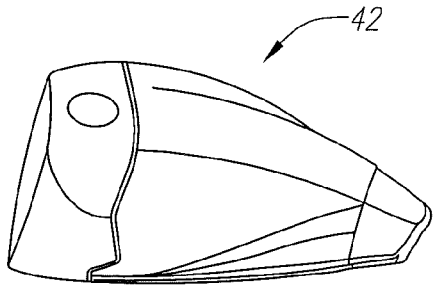
FIG. 7 is a heel side view of the club head of FIG. 1.
Figure 8:
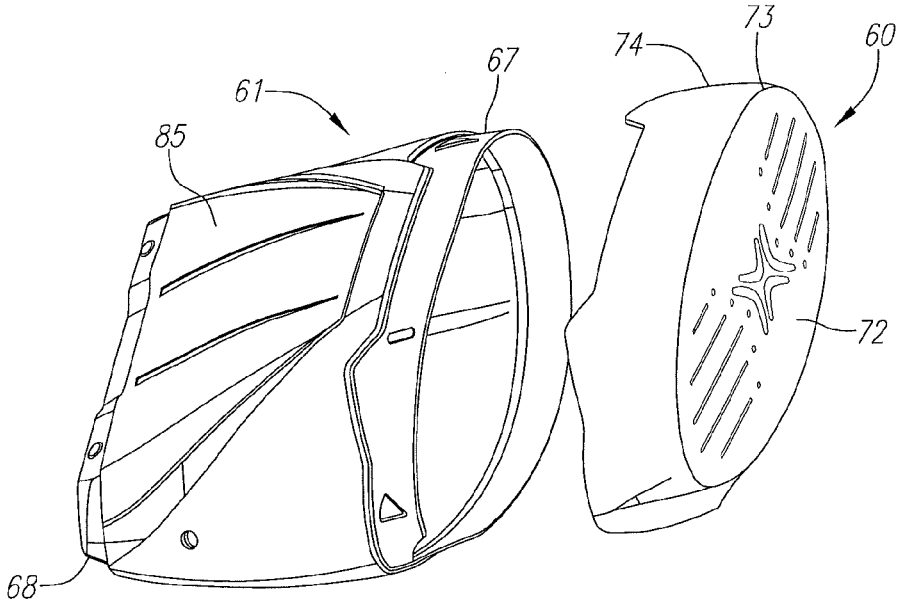
FIG. 8 is an exploded view of a club head of the present invention.
Figure 9:
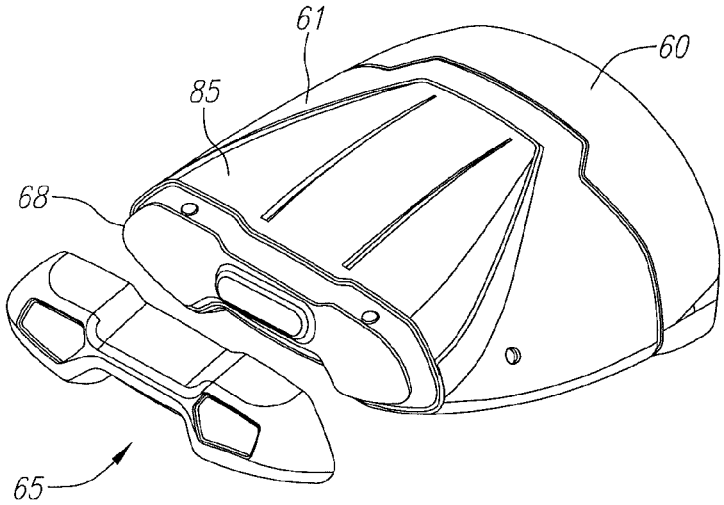
FIG. 9 is an exploded view of a club head of the present invention.

As shown in FIG. 5, the aft end 170 has a distance, "Daw", from a widest extent of the heel end 166 of the club head to a widest extent of the toe end 168 of the club head 42 that preferably ranges from 2.00 to 5.00 inches, more preferably from 3.0 to 5.0 inches, and most preferably from 4.5 to 5.0 inches. In one embodiment, the distances Dhw, Dtw and Daw are all equal in length ranging from 4.0 to 5.0 inches. In an alternative embodiment, the distances Dhw and Dtw are equal in length ranging from 4.5 to 5.0 inches.

Figure 10:
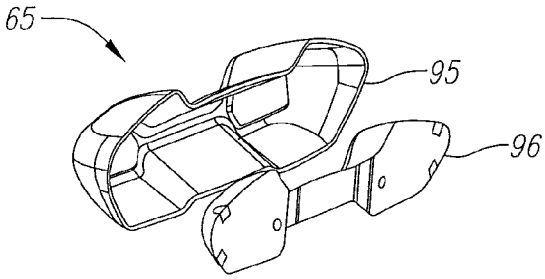
FIG. 10 is an isolated exploded view of a rear weight component.
Figure 11:
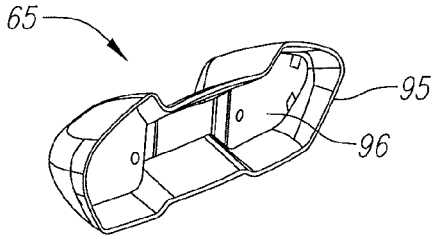
FIG. 11 is an isolated interior view of a rear weight component.
Figure 12:
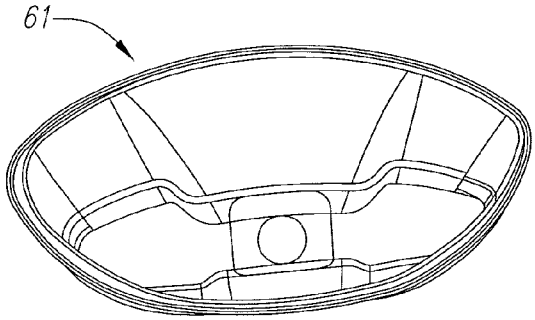
FIG. 12 is an isolated interior view of a mid-body.
Figure 13:
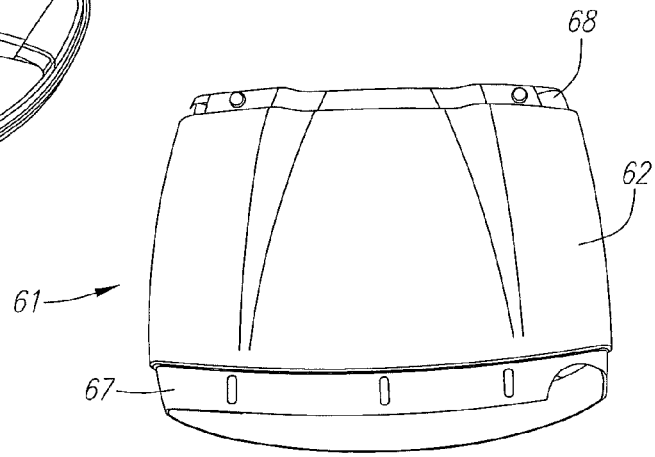
FIG. 13 is an isolated top plan view of a mid-body.
Figure 14:
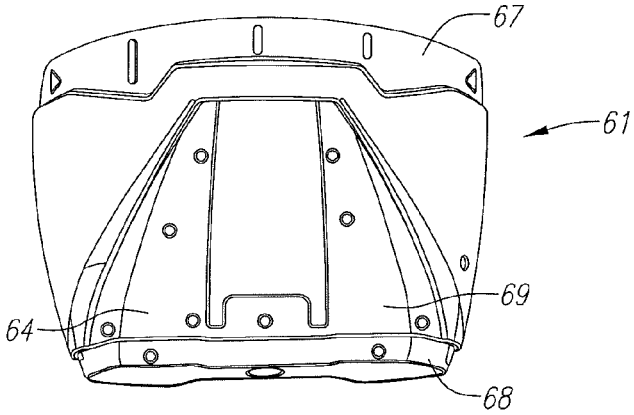
FIG. 14 is an isolated bottom plan view of a mid-body.
Figure 15:
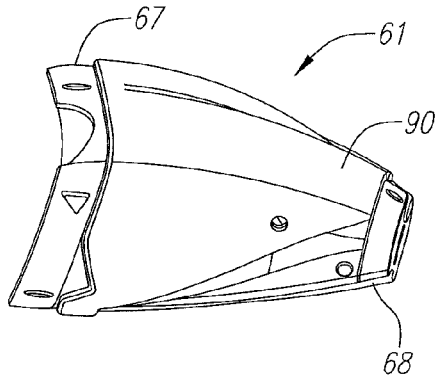
FIG. 15 is an isolated side view of a mid-body.
Figure 16:
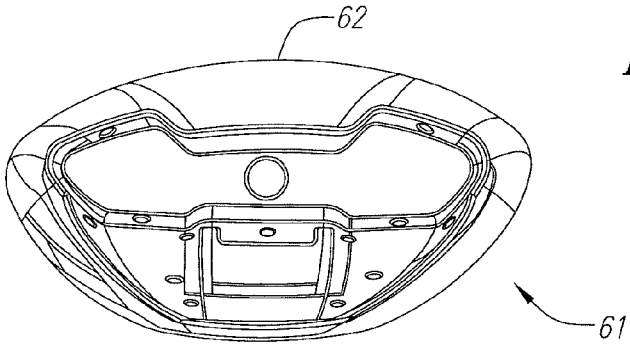
FIG. 16 is an isolated rear view of a mid-body.
Figure 17:
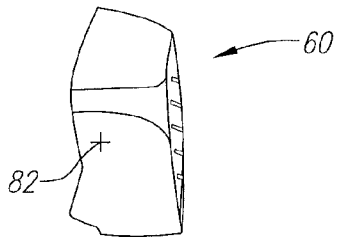
FIG. 17 is an isolated toe-side view of a face component.
Figure 18:
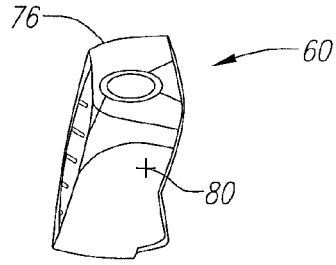
FIG. 18 is an isolated heel-side view of a face component.
Figure 19:
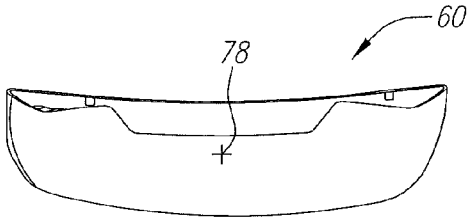
FIG. 19 is an isolated bottom plan view of a face component.

In a preferred embodiment, the aft weight component 65 is preferably positioned on a rear inlaid portion 68 of the mid-body 61. As shown in FIGS. 10 and 11, the aft-weight component 65 generally includes two parts, a cap 95 and a weight member 96. The weight member 96 is preferably bonded to the cap 95 using an adhesive material. The aft weight component 65 increases the moment of inertia of the club head 42, influences the center of gravity, and/or influences other inherent mass properties of the golf club head 42.

The cap 95 is preferably composed of a light-weight material, most preferably aluminum or an aluminum alloy. The cap 95 generally has a thickness ranging from 0.02 to 0.10 inch, and most preferably from 0.03 inch to 0.04 inch. The cap 95 preferably has a mass ranging from 5 to 20 grams, and most preferably approximately 10 grams.

Individually, each weight member 96 has a mass ranging from 5 grams to 30 grams. Each weight member 96 is preferably composed of a material that has a density ranging from 5 grams per cubic centimeters to 20 grams per cubic centimeters, more preferably from 7 grams per cubic centimeters to 12 grams per cubic centimeters. The "dumbbell" like shape of the weight member 96 allows for the mass of the aft-weight component to be focused for a fade golf drive, a neutral golf drive or a draw golf drive.

Each weight member 96 is preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyester polyurethane. A preferred weight member 96 is an injection molded thermoplastic polyurethane integrated with tungsten to have a density of 8.0 grams per cubic centimeters. In a preferred embodiment, each weight member 96 is composed of from 50 to 95 volume percent polyurethane and from 50 to 5 volume percent tungsten. Also, in a preferred embodiment, each weight member 96 is composed of from 10 to 25 weight percent polyurethane and from 90 to 75 weight percent tungsten.

Those skilled in the pertinent art will recognize that other weighting materials may be utilized for the aft weight component 65 without departing from the scope and spirit of the present invention. The placement of the aft weight component 65 allows for the moment of inertia of the golf club head 42 to be optimized.

Alternatively, the weight member 96 is composed of tungsten loaded film, tungsten doped polymers, or similar weighting mechanisms such as described in U.S. Pat. No. 6,386,990, entitled A Composite Golf Club Head With An Integral Weight Strip, and hereby incorporated by reference in its entirety. Those skilled in the pertinent art will recognize that other high density materials, such as lead-free pewter, may be utilized as an optional weight without departing from the scope and spirit of the present invention.

Figure 20:
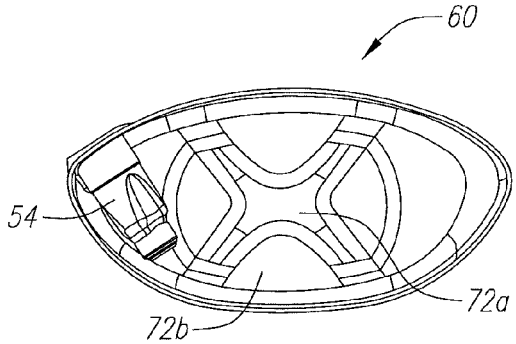
FIG. 20 is an isolated interior view of a face component.
Figure 21:
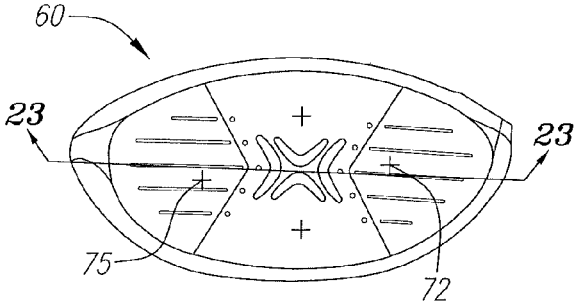
FIG. 21 is an isolated front view of a face component.
Figure 22:
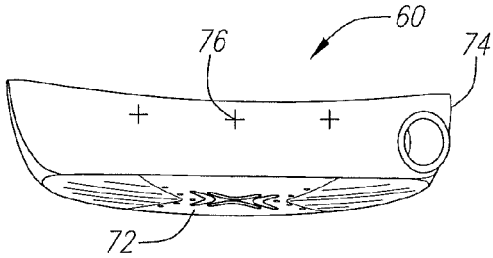
FIG. 22 is an isolated top view of a face component.
Figure 23:
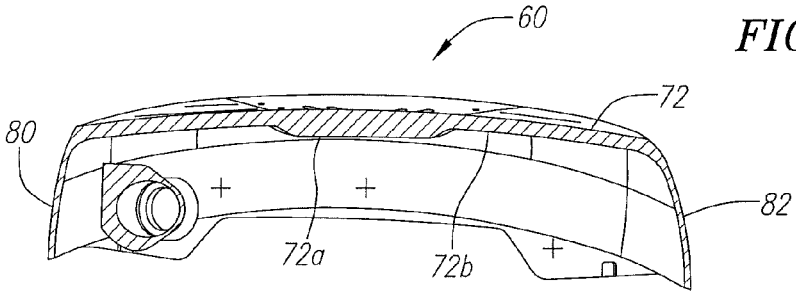
FIG. 23 is a cross-sectional view of a face component along line 23-23 of FIG. 21.

As shown in FIGS. 20 and 23, the striking plate 72 of the face component 60 preferably has varying thickness wherein portion 72*a* is thicker than 72*b* and wherein portion 72*a* has an X like shape. In a preferred embodiment, the striking plate portion 72 has a varying thickness such as described in U.S. Pat. No. 7,258,626, for a Golf Club Striking Plate With Variable Thickness, which pertinent parts are hereby incorporated by reference. Other alternative embodiments of the thickness of the striking plate 72 are disclosed in U.S. Pat. No. 6,471,603, for a Contoured Golf Club Face and U.S. Pat. No. 6,368,234, for a Golf Club Striking Plate Having Elliptical Regions Of Thickness, U.S. Pat. No. 6,398,666, for a Golf Club Striking Plate With Variable Thickness which are owned by Callaway Golf Company and which pertinent parts are hereby incorporated by reference. Alternatively, the striking plate 72 has a uniform thickness.

As mentioned previously, the face component 60 is preferably forged from a rod of metal material. One preferred forging process for manufacturing the face component is set forth in U.S. Pat. No. 6,440,011, entitled Method For Processing A Striking Plate For A Golf Club Head, and hereby incorporated by reference in its entirety. Alternatively, the face component 60 is cast from molten metal in a method such as the well-known lost-wax casting method. The metal for forging or casting is preferably titanium or a titanium alloy such as 6-4 titanium alloy, alpha-beta titanium alloy or beta titanium alloy for forging, and 6-4 titanium for casting.

Additional methods for manufacturing the face component 60 include forming the face component 60 from a flat sheet of metal, super-plastic forming the face component 60 from a flat sheet of metal, machining the face component 60 from a solid block of metal, electrochemical milling the face from a forged pre-form, and like manufacturing methods. Yet further methods include diffusion bonding titanium sheets to yield a variable face thickness face and then superplastic forming. Alternatively, the face component 60 is composed of an amorphous metal material such as disclosed in U.S. Pat. No. 6,471,604 and is hereby incorporated by reference in its entirety.

In a preferred embodiment, the golf club head 42 has a high coefficient of restitution thereby enabling for greater distance of a golf ball hit with the golf club head 42. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head 42 having a coefficient of restitution ranging from 0.81 to 0.94, as measured under conventional test conditions.

The coefficient of restitution of the club head 42 under standard USGA test conditions with a given ball ranges from approximately 0.81 to 0.94, preferably ranges from 0.825 to 0.883 and is most preferably 0.845.

The United States Golf Association ("USGA") has set forth a test for determining the flexibility of a golf club head. The test procedure is available at www.USGA.org under *Procedure For Measuring The Flexibility Of A Golf Clubhead*. The test uses a pendulum testing apparatus to determine the characteristic time ("CT") between a clubhead and a pendulum during impact. In order to be in conformity with the Rule of Golf as set forth and interpreted by the USGA, the CT must not be greater than 239 milliseconds plus a tolerance of 18 milliseconds for a total of 257 milliseconds. U.S. Pat. No. 6,505,498 and U.S. Patent Publication Number 2004/0182131 each disclose a pendulum testing apparatus which may be used to determine the CT of a club head. The golf club head 42 preferably has a CT value, under standard USGA conditions which are hereby incorporated by reference in their entirety, that is equal to or less than 257 milliseconds at 1 meter/second.

Additionally, the striking plate 72 of the face component 60 has a more rectangular face providing a greater aspect ratio. The aspect ratio as used herein is defined as the width, "W", of the face divided by the height, "H", of the face. In one preferred embodiment, the width W is 100 millimeters and the height H is 56 millimeters giving an aspect ratio of 1.8. The striking plate portion 72 of the present invention preferably has an aspect ratio that is greater than 1.8 for a club head having a volume greater than 450 cubic centimeters.

The face area of the striking plate 72 preferably ranges from 5.00 square inches to 10.0 square inches, more preferably from 6.0 square inches to 9.5 square inches, and most preferably from 7.0 square inches to 9.0 square inches.

Figure 24:
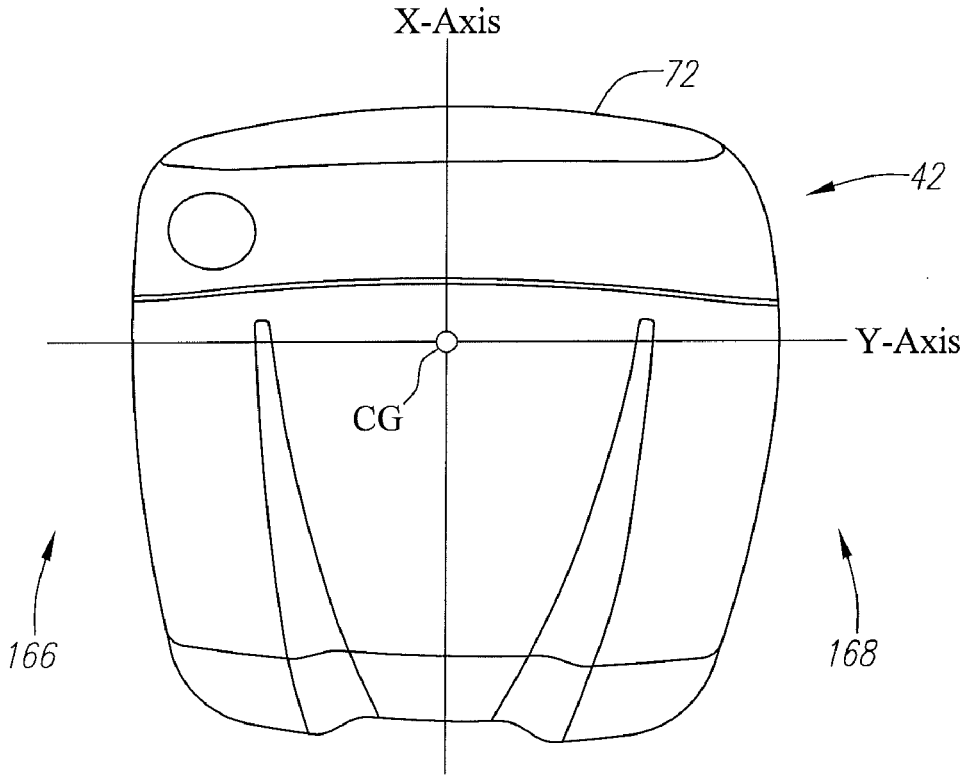
FIG. 24 is a top plan view of a golf club head illustrating the X-axis and Y-axis through a center of gravity, CG, of the golf club head.
Figure 25:
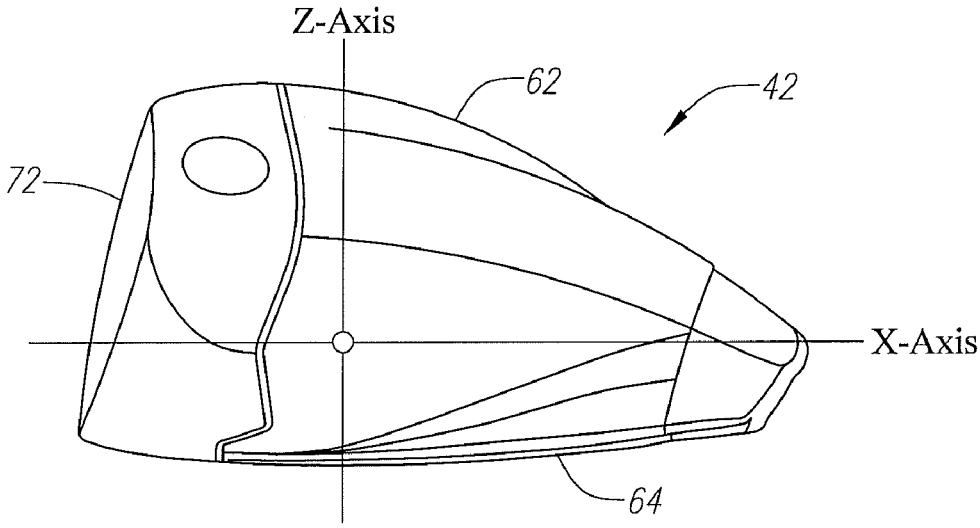
FIG. 25 is a heel side view of a golf club head illustrating the X-axis and Z-axis through a center of gravity, CG, of the golf club head.

FIGS. 24 and 25 illustrate the axes of inertia through the center of gravity of the golf club head. The axes of inertia are designated X, Y and Z. The X-axis extends from the striking plate 72 through the center of gravity, CG, and to the rear of the golf club head 42. The Y-axis extends from the toe end 168 of the golf club head 42 through the center of gravity, CG, and to the heel end 166 of the golf club head 42. The Z-axis extends from the crown section 62 through the center of gravity, CG, and through the sole section 64.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 42 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction. Those skilled in the pertinent art will recognize other methods to determine the center of gravity and moments of inertia of a golf club head.

In general, the moment of inertia, Izz, about the Z axis for the golf club head 42 of the present invention will range from 3500 g-cm$^2$ to 6000 g-cm$^2$, preferably from 4000 g-cm$^2$ to 5500 g-cm$^2$, and most preferably from 4200 g-cm$^2$ to 5000 g-cm$^2$. The moment of inertia, Iyy, about the Y axis for the golf club head 42 of the present invention will range from 2000 g-cm$^2$ to 4000 g-cm$^2$, preferably from 2500 g-cm$^2$ to 3500 g-cm$^2$, and most preferably from 2900 g-cm$^2$ to 3300 g-cm$^2$. The moment of inertia, Ixx, about the X axis for the golf club head 42 of the present invention will range from 2000 g-cm$^2$ to 4000 g-cm$^2$, preferably from 2500 g-cm$^2$ to 3750 g-cm$^2$, and most preferably from 3000 g-cm$^2$ to 3500 g-cm$^2$.

In general, the golf club head 42 has products of inertia such as disclosed in U.S. Pat. No. 6,425,832 which is hereby incorporated by reference in its entirety. Preferably, each of the products of inertia, Ixy, Ixz and Iyz, of the golf club head 42 have an absolute value less than 100 grams-centimeter squared. Alternatively, at least two of the products of inertia, Ixy, Ixz or Iyz, of the golf club head 42 have an absolute value less than 100 grams-centimeter squared.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A wood-type golf club head comprising:

a face component comprising a striking plate portion and a return portion extending rearward from the striking plate portion, the face component composed of a metal material and having a face area ranging from 5.00 square inches to 10.0 square inches;

a mid-body composed of a non-metal material; and an aft-weight component attached to the mid-body;

wherein the golf club head has a volume ranging from 450 cubic centimeters to 475 cubic centimeters;

wherein the golf club head has a mass ranging from 180 grams to 225 grams;

wherein the golf club head has a length as measured from the forwardmost extent of the front wall to a rearward most extent of the rear wall ranging from 4.0 inches to 5.0 inches;

wherein the golf club head has a moment of inertia, Izz, about the center of gravity of the golf club head greater than 4000 grams-centimeters squared;

wherein the golf club head has a CT value equal to or less than 257 milliseconds and a coefficient of restitution value ranging from 0.81 to 0.94.

2. The wood-type golf club head according to claim 1 wherein the golf club head has a moment of inertia, Iyy, about the center of gravity of the golf club head ranging from 2000 grams-centimeters squared to 4000 grams-centimeters squared.

3. The wood-type golf club head according to claim 1 wherein the face component is composed of a formed titanium alloy.

4. The wood-type golf club head according to claim 1 wherein the cap of the aft-weight component is composed of an aluminum alloy and the weight member is composed of a polyester polyurethane material integrated with tungsten.

5. The wood-type golf club head according to claim 1 wherein the aft-weight component is weighted to provide the wood-type golf club head with a draw bias.

6. The wood-type golf club head according to claim 1 wherein the aft-weight component is weighted to provide the wood-type golf club head with a fade bias.

7. The wood-type golf club head according to claim 1 wherein the aft-weight component is weighted to provide the wood-type golf club head with a neutral bias.

8. The wood-type golf club head according to claim 1 wherein the mid-body is composed of plies of pre-preg material.

9. The wood-type golf club head according to claim 1 wherein the striking plate of the face component has an interior surface with a first thickness and a second thickness wherein the first thickness is greater than the second thickness and the first thickness has an X like shape.

* * * * *